US005393125A

United States Patent [19]

Watson et al.

[11] Patent Number: 5,393,125

[45] Date of Patent: Feb. 28, 1995

[54] HEIGHT ADJUSTABLE CHAIR ARM ASSEMBLY

[75] Inventors: Ron K. Watson, Coppell, Tex.; James M. Mancewicz, Wyoming, Mich.

[73] Assignee: Steelcase Inc., Grand Rapids, Mich.

[21] Appl. No.: 69,289

[22] Filed: May 28, 1993

[51] Int. Cl.[6] ..... A47C 7/54

[52] U.S. Cl. ..... 297/411.36; 297/344.18; 248/118.3; 248/414

[58] Field of Search ..... 297/115, 215.14, 344.18, 297/411.36, 411.3, 410; 248/118.3, 406.2, 414, 411, 423

[56] References Cited

U.S. PATENT DOCUMENTS

| | | |
|---|---|---|
| 42,650 | 5/1864 | Emery . |
| 251,069 | 12/1881 | Shaw . |
| 320,487 | 6/1885 | Matthie . |
| 346,784 | 8/1886 | Stanford . |
| 441,964 | 12/1890 | Neppert . |
| 449,689 | 4/1891 | Nauts . |
| 478,840 | 7/1892 | Biggs et al. . |
| 481,293 | 8/1892 | Bailey et al. . |
| 493,111 | 3/1893 | Parsons . |
| 493,441 | 3/1893 | Munz . |
| 533,619 | 2/1895 | Stuebing . |
| 550,685 | 12/1895 | Munz . |
| 560,547 | 5/1896 | Shotwell et al. . |
| 659,089 | 10/1900 | McKinney . |
| 720,549 | 2/1903 | Adler . |
| 782,364 | 2/1905 | Soule . |
| 1,025,476 | 5/1912 | Mellen . |
| 1,070,278 | 8/1913 | McKinney . |
| 1,407,174 | 2/1922 | Simpson . |
| 2,310,346 | 2/1943 | Bell . |
| 2,549,902 | 4/1951 | Hibbard et al. . |
| 2,584,732 | 2/1952 | Okun . |
| 2,605,987 | 8/1952 | Brown et al. . |
| 2,650,650 | 9/1953 | Brown . |
| 3,063,752 | 11/1962 | Moore . |
| 3,124,328 | 3/1964 | Kortsch . |
| 3,206,249 | 9/1965 | Gateley . |
| 3,215,470 | 11/1965 | Swenson et al. . |
| 3,376,066 | 4/1968 | Kernes . |
| 3,474,993 | 10/1969 | Murcott . |
| 3,642,088 | 2/1972 | Smith . |
| 3,770,236 | 11/1973 | Marsh et al. . |
| 3,992,058 | 11/1976 | Mitjans . |
| 3,993,351 | 11/1976 | Rodaway . |
| 4,003,168 | 1/1977 | Brady . |
| 4,085,763 | 4/1978 | Thomas . |

(List continued on next page.)

FOREIGN PATENT DOCUMENTS

| | | | |
|---|---|---|---|
| 168984 | 9/1934 | Switzerland | 297/344.18 |
| 958316 | 5/1964 | United Kingdom | 297/344.18 |
| 1481185 | 7/1977 | United Kingdom . | |

OTHER PUBLICATIONS

RH Form AB "Facts and Technical Details" literature.

The Chair Works "An Engineered Solution to Your Seating Needs" literature.

*Form & Function*, By Stephen MacDonald, "Elbow Support Chair".

*Primary Examiner*—Laurie K. Cranmer

*Attorney, Agent, or Firm*—Price, Heneveld, Cooper, DeWitt & Litton

[57] ABSTRACT

A height adjustable chair arm assembly includes an inner tube joined to an arm support of a chair, an elongated lock plate disposed within the inner tube and a lock tube assembly including an upper lock release housing and an elongated guide tube telescopingly disposed within the inner tube. The elongated lock plate defines a plurality of vertically spaced sockets or lock indentations. An elongated lock rod is movably disposed within the lock tube. A ball lock element, disposed within the lock tube, is engaged by the lock rod. The rod is movable from a locked position wherein the rod holds the lock element within one of the indentations and an unlocked position wherein the lock element may move out of the indentation and the lock tube assembly may telescope with respect to the inner tube. An armrest or arm cap is fixed to an upper end of the lock tube assembly.

29 Claims, 2 Drawing Sheets

U.S. PATENT DOCUMENTS 4,163,536 8/1979 Heller et al. .
4,277,102 7/1981 Aaras et al. .
4,456,298 6/1984 Gottstein .
4,489,980 12/1984 Friedrich .
4,489,981 12/1984 Goletski .
4,565,409 1/1986 Hollonbeck et al. .
4,660,885 4/1987 Suhr et al. .
4,693,442 9/1987 Sills .
4,786,108 11/1988 Dauphin .
4,815,688 3/1989 Wood .
4,822,103 4/1989 Stenvall .
4,844,390 7/1989 Duke .
4,951,995 8/1990 Teppo et al. .
4,961,610 10/1990 Reeder et al. .
4,968,094 11/1990 Froyland et al. .
4,971,393 11/1990 Maisenhalder .
5,050,933 9/1991 Tornero et al. .
5,056,863 10/1991 DeKraker et al. .
5,058,840 10/1991 Moss et al. .
5,088,668 2/1992 Grimm .
5,104,073 4/1992 VanBeek et al. .
5,135,190 8/1992 Wilson .
5,143,422 9/1992 Althofer et al. .
5,215,282 6/1993 Bonutti .

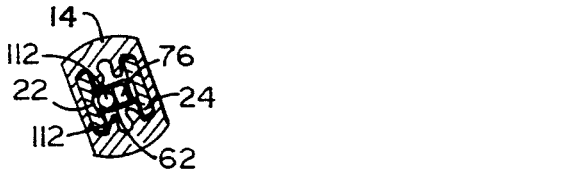
FIG. 2
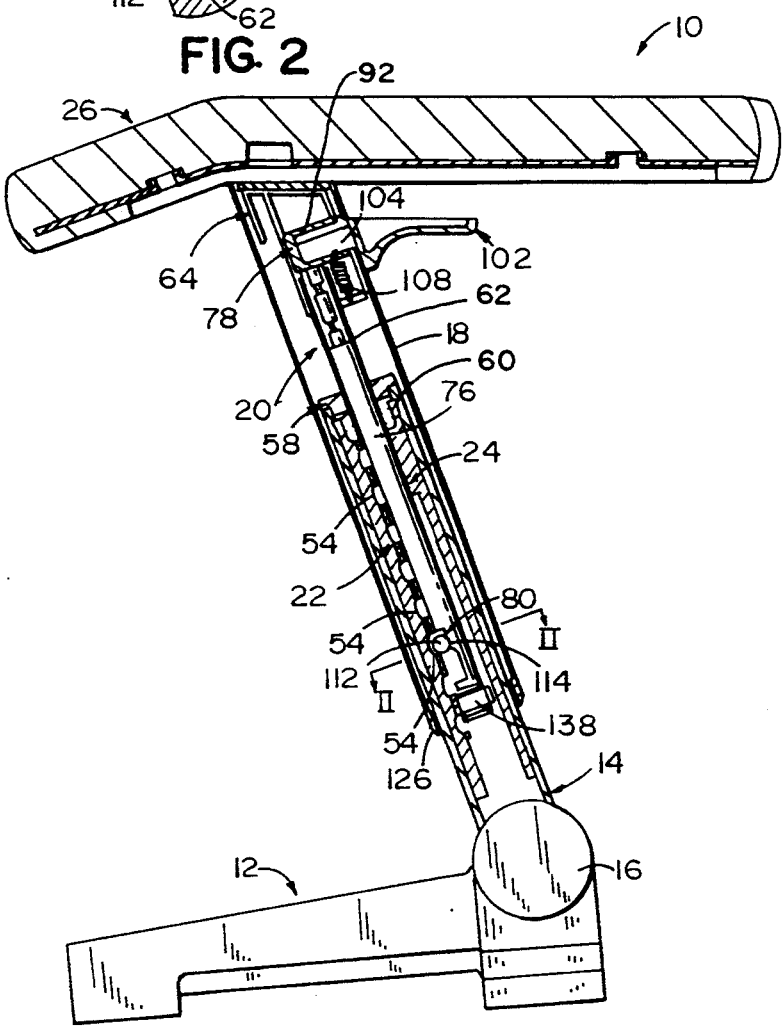
FIG. 1
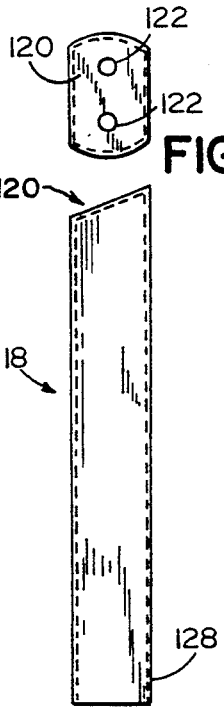
FIG. 6
FIG. 5
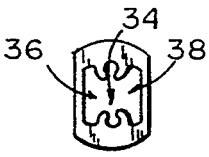
FIG. 4
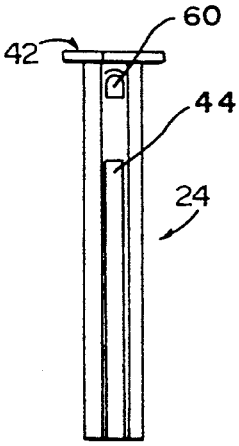
FIG. 12
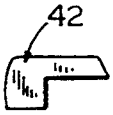
FIG. 13
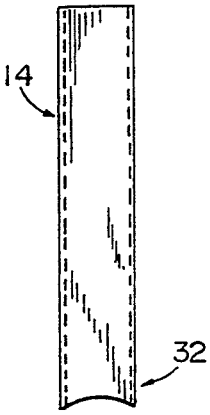
FIG. 3

HEIGHT ADJUSTABLE CHAIR ARM ASSEMBLY

BACKGROUND OF THE INVENTION

The present invention relates to chairs and, more particularly, to an arm assembly for a chair which includes a height adjustment mechanism.

Presently a wide variety of office chairs with adjustment features are available. The chairs are adjustable to the particular user or to the task being undertaken. Such chairs may include seat height adjustment mechanisms, back height adjustment mechanisms and adjustable armrests. In many such chairs, the vertical positioning of the armrests is fixed with respect to the seat and, hence, the user. Various proposals have been made for providing height adjustment of the arm assemblies. An example of one such proposal may be found in commonly owned U.S. Pat. No. 4,951,995 entitled ARM HEIGHT ADJUSTMENT MECHANISM FOR A CHAIR, which issued on Aug. 28, 1990 to Teppo et al. The arm height adjustment mechanism disclosed therein permits synchronized, simultaneous adjustment of the armrests with respect to their supports and the chair seat.

Other mechanisms heretofore available provide limited, independent height adjustment of each armrest. A need exists, however, for an arm height adjustment mechanism and arm assembly which provides reliable operation at reduced cost and which readily adapts the chair arm height to the vast majority of expected users and tasks.

SUMMARY OF THE INVENTION

In accordance with the present invention, the aforementioned needs are substantially fulfilled. Essentially, an arm height adjustment mechanism for a chair arm assembly is provided which includes a support tube adapted to be fixed to the chair. An elongated lock member is fixed within the support tube. The lock member defines a plurality of vertically spaced lock sockets, apertures or indentations. An elongated lock guide tube is slideably mounted within the support tube adjacent the lock member. The lock guide is adapted to support an arm cap or armrest. A lock rod is positioned within the elongated lock guide tube for limited vertical movement between a locked position and an unlocked position. A lock element is engaged by a lower end of the lock rod. The lock rod lower end is configured to engage the lock element and hold it within one of the spaced lock sockets when the lock rod is in the locked position. Vertical movement of the lock rod allows the lock element to move out of engagement with the lock socket allowing the lock guide tube and armrest to be moved vertically with respect to the support tube.

In narrower aspects of the invention, an outer tube surrounds the elongated lock guide tube and telescopes over the inner support tube. A release button or lever is slideably mounted on the lock guide tube. The lock rod is fixed to the release lever. Provision is made for resiliently biasing the release lever and lock tube to the locked position.

The arm height adjustment mechanism and arm assembly in accordance with the present invention provides for reliable vertical height adjustment of the arm cap or armrest. The assembly may be easily manufactured, assembled and provides for reliable, stable operation. The assembly is adaptable to a wide variety of different office chairs.

BRIEF DESCRIPTION OF THE DRAWINGS

FIG. 1 is a elevational view in cross section of the chair arm assembly in accordance with the present invention;

FIG. 2 is a cross-sectional view taken generally along line II—II of FIG. 1;

FIG. 3 is an elevational view of an inner or support tube incorporated in the present invention;

FIG. 4 is a top, plan view of the tube of FIG. 3;

FIG. 5 is an elevational view of an outer tube incorporated in the present invention;

FIG. 6 is a top, plan view of the tube of FIG. 5;

FIG. 12 is an elevational view of a guide plate incorporated in the present invention;

FIG. 13 is a top plan view of the guide plate;

DETAILED DESCRIPTION OF THE PREFERRED EMBODIMENT

Figure 16:
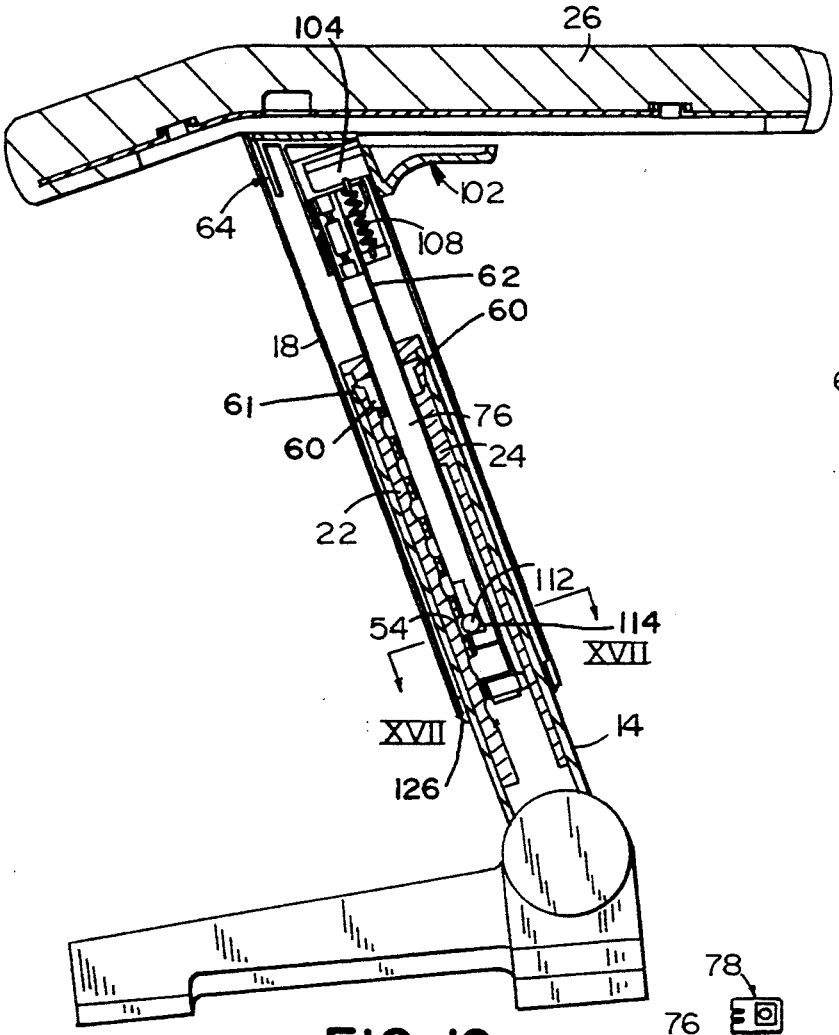
FIG. 16 is an elevational view in cross section of the chair arm assembly in accordance with the present invention showing the lock rod in the unlocked position.

A preferred embodiment of a chair arm assembly in accordance with the present invention is illustrated in FIG. 1 and generally designated by the numeral 10. Assembly 10 includes an arm support casting 12. Casting 12 is adapted to be fixed to a chair adjacent the seat thereof. An inner tube or support tube 14 is fixed to casting 12 and adjacent end 16 of the casting. An outer tube 18 telescopes over inner tube 14. An elongated lock guide assembly 20 telescopes within inner tube 14. Assembly 20 telescopes with respect to an elongated lock plate 22 and a guide plate 24. An armrest or arm cap 26 is fixed to an upper end of assembly 20.

Inner tube 14, as best seen in FIGS. 3 and 4, is an elongated member including a lower end 32 adapted to conform to the outer surface of end 16 of casting 12. Tube 14 defines an elongated internal bore or passageway 34. Passageway 34 includes a lock member portion 36 and a configured guide plate portion 38.

Guide plate 24, as seen in FIGS. 2, 12 and 13, has a generally rectangular configuration in cross section. The plate includes an upper generally L-shaped cap or flange 42 and a channel 44. The guide plate is configured to be received within and retained by bore portion 38 of inner tube 14.

Figure 15:
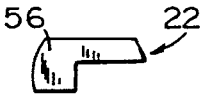
FIG. 15 is a top, plan view of the lock plate.
Figure 17:
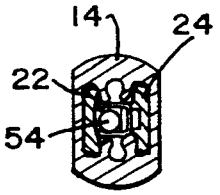
FIG. 17 is a cross-sectional view taken generally along line XVII—XVII of FIG. 16.
Figure 14:
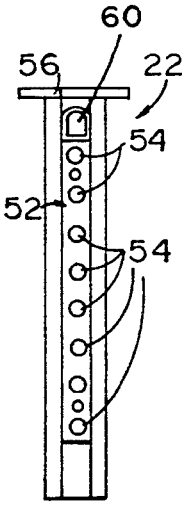
FIG. 14 is an elevational view of an elongated lock plate or member incorporated in the present invention.

Lock plate 22, as seen in FIGS. 2, 14 and 15, also has a rectangular shape in cross section. The plate is configured to be disposed within bore 36 of inner tube 14. Plate 22 includes a surface 52 and a plurality of generally circular sockets, apertures or indentations 54 vertically spaced along surface 52. Lock plate 22 further includes a generally L-shaped upper flange 56. Flanges 42 and 56 of plates 24, 22 are mirror images of each other. When the plates are disposed within their respective bores 36, 38, flanges 56 define a cap 58 (FIG. 1) having a central opening. Plates 22, 24 are retained in position within their respective bores 36, 38 by cap 58. Plates 22 and 24 each define detent retention tabs 60 which are received within detent slots 61 defined by tube 14. Tabs 60 prevent upward movement or withdrawal of the plates from inner tube 14.

Figure 9:
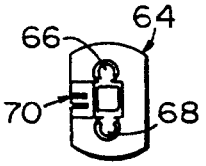
FIG. 9 is a top, plan view of the assembly of FIG. 8.
Figure 8:
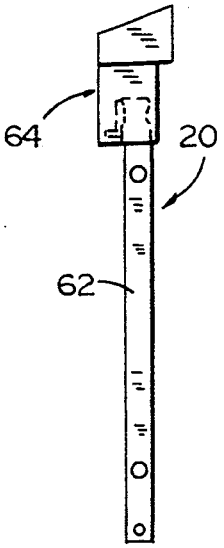
FIG. 8 is an elevational view of a lock guide tube and housing assembly incorporated in the present invention.
Figure 11:
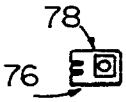
FIG. 11 is a top, plan view of the rod of FIG. 10.

Assembly 20, as seen in FIGS. 1, 2, 8 and 9, includes an elongated lock tube portion 62 and an upper lock release housing 64. Housing 64, as seen in FIG. 9, defines spaced, generally circular bores or apertures 66, 68 and a slot 70.

An elongated lock rod 76, as seen in FIGS. 1, 2, 10 and 11, is slideably disposed within tube 62 of assembly 20. Lock rod 76 includes an upper portion 78 and a lower end 80 having a configured slot 82. Slot 82 includes a first upper portion 84 and a lower portion 86 joined thereto along an angled ramp or cam surface 88. Portion 84 has a width less than the width of portion 86.

Upper end 78 of lock rod 76 defines a socket 92. Socket 78 receives a release button or lever 102. Lever 102 includes a male portion 104 which extends through a suitable slot in outer tube 18, slot 70 of lock release housing 64 and into socket 78. As shown in FIG. 1, a spring 108 has an end fixed to lock release housing 64 and an end fixed to male portion 104 or release lever or button 102. Spring 108 resiliently biases rod 76 to its locked position.

As seen in FIGS. 1 and 2, elongated guide tube portion 62 defines an aperture 112. A lock element in the form of a ball bearing 114 is disposed within aperture 112. Ball bearing 112 is engaged by lower end 80 of lock rod 76.

Figure 7:
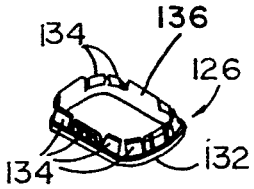
FIG. 7 is a perspective view of a bushing incorporated in the present invention.
Figure 10:
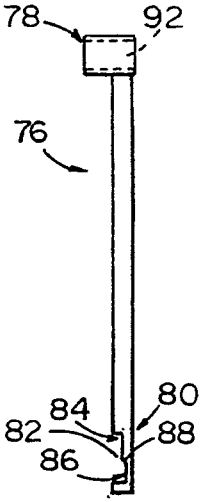
FIG. 10 is an elevational view of a lock rod incorporated in the present invention.

Outer tube 18, as seen in FIGS. 5 and 6, is an elongated, generally tubular member including a closed upper end 120 defining arm cap attachment apertures 122. A bushing 126 is positioned within lower end 128 of tube 18. Bushing 126, as seen in FIG. 7, conforms to the configuration of outer tube 18 and includes a peripheral, generally horizontal flange 132 and a plurality of attachment tabs 134. Bushing 126 is press-fitted into the lower end of tube 18. An inner surface 136 slides along the outer surface of inner tube 14.

The arm height adjustment mechanism in accordance with the present invention is assembled by attaching tube 14 to a suitable support such as the arm support casting 12 as shown in FIG. 1. Tube 14 could be part of and, hence, joined to a tubular arm support of the type found in the aforementioned U.S. Pat. No. 4,951,995. Lock plate 22 and guide plate 24 are slipped into their respective configured bores 36, 38 of tube 14. Lock rod 76 is slipped into assembly 20. Coil spring 108 is attached to lock release housing portion 64 and to release button 102 which is connected to socket portion 78 of the lock rod. When positioning rod 76 within tubular portion 62, ball bearing or lock element 112 is disposed within the enlarged portion 86 of slot 84. Ball 112 is positioned at aperture 114 in tube 62. Outer tube 18 is slipped over assembly 20. The outer tube and arm cap 26 are attached thereto by suitable fasteners passing through apertures 122 in outer tube 18 and which are threadably received within bores 66, 68 of housing 64. Arm cap 26, tube 18 and assembly 20 will, therefore, move as a unit which is selectively locked to inner tube 14 by lock rod 76, ball 114 and plate 22.

As seen in FIGS. 1 and 16, a stop plug 138 extends between apertures formed in the lower end of guide tube portion 62. Stop 138 engages closure 58 fixed to inner tube 14 to limit outward movement or prevent removal of assembly 20 from inner tube 14.

When the assembly is in the locked position as seen in FIG. 1, lock element 112 is retained within one of the lock sockets 54 by lock rod end 80. Slot portion 84 is dimensioned to retain element 112 in locking engagement with a socket 54. Lock rod 76 is biased to its locked position within tubular portion 62 by spring 108.

As shown in FIG. 16, vertical height adjustment of arm cap 26 with respect to inner support 14 is accomplished by moving release button or lever upwardly with respect to tube 14. This movement raises lock rod 76 so that lock element 112 can move out of engagement with the engaged socket 54 in lock plate 22. As shown in FIG. 16, ball 112 is allowed to move into the enlarged space defined by slot portion 86 of lower end 80. When in this position, further upward movement of release button 102 causes assembly 20 to telescope upwardly with respect to inner tube 14 thereby raising arm cap 26. Releasing button 102 causes spring 108 to bias or move rod 76 back towards its locked position. Ramp portion 88 of the slot will then cam ball 112 into another lock socket 54, thereby locking the armrest in another position with respect to inner tube 14. Bushing 126, preferably formed with plastic, snap-fits into lower end of tube 18 and engages the outer surface of inner tube 14. Bushing 126 provides a sliding surface for the lower end of the outer tube as well as support for the lower end of the tube to minimize any loose feel in the arm and provide a stable assembly.

Simple vertical movement of the lock rod within the lock guide tube releases the ball from the socket or indentation in the lock plate to permit vertical height adjustment. Because of the configuration of the lower end of the lock rod and lock guide tube, the ball is never fully released from the hole or aperture in the lock guide tube. The ball is moved vertically as the armrest is raised and lowered. The ball is forced into a socket when the ball and socket are aligned and lever 102 is released. Lever 102 and spring 108 cause the lock rod to move down to its locked position.

The arm height adjustment mechanism in accordance with the present invention is relatively easily manufactured and assembled. Positive locking action is provided. In a presently existing embodiment, sockets 54 are spaced to provide adjustment increments of 0.5 inches. The total adjustment from the lowest to the highest position is 3.5 inches. Outer tube 18 is preferably manufactured from steel. Inner tube 14 is fabricated from aluminum. Fabrication of bushing 126 from plastic provides a self-lubricating bearing which provides for smooth operation. The outer tube and inner tube fully enclose the lock mechanism providing an aesthetically pleasing appearance. Large bearing surfaces are provided by the inner tube, lock plate and guide plate further insuring a stable feel and smooth operation. The height adjustment mechanism is adaptable to a wide variety of chairs. The inner tube is readily formed as part of the chair assembly or as a separate piece attached to an arm support casting as shown.

In view of the above description, those of ordinary skill fin the art may envision various modifications which would not depart from the inventive concepts disclosed herein. It is expressly intended, therefore, that the above description should be considered as only that of the preferred embodiment. The true spirit and scope of the present invention may be determined by reference to the appended claims.

The embodiments of the invention in which an exclusive property or privilege is claimed are defined as follows:

1. An arm mechanism for a chair, comprising:

an armrest support adapted to be fixed to a chair, said support defining a plurality of vertically spaced lock sockets;

an elongated lock guide tube slideably mounted within said support;

an armrest joined to said guide tube;

a lock rod having a configured lower end, said rod being slideably disposed within said guide tube and movable from a locked position to an unlocked position;

a lock element within said lock guide tube, said lock element being engaged by said lower end of said lock rod and being retained within one of said sockets when said rod is in the locked position and being released from one of the sockets when said rod is in the unlocked position permitting the lock guide tube to be moved vertically with respect to said armrest support;

a spring connected to the lock rod for biasing the lock rod to the locked position; and an outer tube surrounding the lock guide tube and telescoping with said armrest support.

2. An arm mechanism as defined by claim 1 wherein said lock guide tube defines an aperture through which said lock element extends.

3. An arm mechanism as defined by claim 2 wherein the lower end of said lock rod has a stepped configuration including a first portion engaging and retaining the lock element within said socket.

4. An arm mechanism as defined by claim 3 wherein said lock rod end includes a second portion positioned adjacent said element when in the unlocked position and permitting said element to move out of said socket.

5. An arm mechanism as defined by claim 1 further including:

a lock release housing joined to said lock guide tube, said armrest being secured to said lock release housing.

6. An arm mechanism as defined by claim 5 further including:

a release lever joined to said lock rod and movable vertically within said lock release housing.

7. An arm height adjustment mechanism for a chair, comprising:

a support tube adapted to be fixed to a chair;

an elongated lock member fixed within said support tube and defining a plurality of vertically spaced lock sockets;

an elongated lock guide tube slideably mounted within said support tube;

an armrest joined to said guide tube;

a lock rod having a lower end, said rod being slideably disposed within said guide tube and movable from a locked position to an unlocked position;

a lock element within said lock guide tube, said lock element being engaged by said lower end of said lock rod and being retained within one of said sockets when said rod is in the locked position and being released from one of the sockets when said rod is in the unlocked position permitting the lock guide tube to be moved vertically with respect to said support tube;

a lock release housing joined to said lock guide tube, said armrest being secured to said lock release housing, a release lever joined to said lock rod and movable vertically within said lock release housing; and resilient means between said housing and said release lever for resiliently biasing said release lever and said lock rod to the locked position, said lock guide tube defining an aperture through which said lock element extends.

8. An arm height adjustment mechanism as defined by claim 7 wherein the lower end of said lock rod has a stepped configuration including a first portion engaging and retaining the lock element within said socket.

9. An arm height adjustment mechanism as defined by claim 8 therein said lock rod end includes a second portion positioned adjacent said element when in the unlocked position and permitting said element to move out of said socket, said first and second portions being joined by a camming portion.

10. An arm height adjustment mechanism for a chair, comprising:

a support tube adapted to be fixed to a chair;

an elongated lock member fixed within said support tube and defining a plurality of vertically spaced lock sockets;

an elongated lock guide tube slideably mounted within said support tube;

an armrest joined to said guide tube;

a lock rod having a lower end, said rod being slideably disposed within said guide tube and movable from a locked position to an unlocked position;

a lock element within said lock guide tube, said lock element being engaged by said lower end of said lock rod and being retained within one of said sockets when said rod is in the locked position and being released from one of the sockets when said rod is in the unlocked position permitting the lock guide tube to be moved vertically with respect to said support tube; and an outer tube surrounding said lock guide tube and telescoping over said support tube.

11. An arm height adjustment mechanism as defined by claim 10 further including:

a bushing disposed between said outer tube and said support tube.

12. An arm height adjustment mechanism as defined by claim 11 further including:

a guide plate disposed within said support tube, said lock guide tube being sandwiched between said guide plate and said elongated lock member.

13. An arm height adjustment mechanism as defined by claim 12 wherein said lock guide tube defines an aperture through which said lock element extends.

14. An arm height adjustment mechanism as defined by claim 13 wherein the lower end of said lock rod has a stepped configuration including a first portion engaging and retaining the lock element with said socket.

15. An arm height adjustment mechanism as defined by claim 14 wherein said lock rod end includes a second portion positioned adjacent said element when in the unlocked position and permitting said element to move out of said socket.

16. An arm height adjustment mechanism as defined by claim 15 wherein said lock element is a ball bearing.

17. An arm height adjustment mechanism as defined by claim 16 further including:

a lock release housing joined to said lock guide tube, said armrest being secured to said lock release housing.

18. An arm height adjustment mechanism as defined by claim 17 further including:

a release button joined to said lock rod and movable vertically within said lock release housing.

19. An arm height adjustment mechanism as defined by claim 18 further including:

resilient means between said housing and said release button for resiliently biasing said release button and said lock rod to the locked position.

20. An arm assembly for a chair, comprising:

an arm support adapted to be secured to a chair;

an inner tube joined to said arm support;

an elongated lock plate disposed within said inner tube, said lock plate defining a plurality of vertically spaced lock indentations;

a lock tube including an upper lock release housing and an elongated guide tube which defines a lock element aperture, said guide tube being telescopingly disposed within said inner tube;

an elongated lock rod movably disposed within said lock tube;

a lock element within said lock aperture, said element being engaged by said lock rod;

a spring operatively connected to the rod and resiliently biasing the rod to a locked position wherein said lock element is retained within one of said indentations preventing vertical movement of the lock tube with respect to said inner tube; and an arm cap mounted on said lock release housing.

21. An arm assembly as defined by claim 20 further comprising:

an outer tube surrounding said lock tube and telescoping over said inner tube.

22. An arm assembly as defined by claim 21 further comprising:

a release lever slideably mounted on said lock release housing, said lock rod being connected to said release lever.

23. An arm assembly as defined by claim 22 wherein said spring engages said release lever.

24. An arm assembly as defined by claim 23 wherein said lock guide tube defines an aperture through which said lock element extends.

25. An arm assembly as defined by claim 24 wherein the lower end of said lock rod has a stepped configuration including a first portion engaging and retaining the lock element with said socket.

26. An arm assembly as defined by claim 25 wherein said lock rod end includes a second portion positioned adjacent said element when in the unlocked position and permitting said element to move out of said socket, said portions being joined by an angled ramp portion.

27. An arm assembly as defined by claim 26 further comprising:

a bushing disposed between said outer tube and said inner tube.

28. An arm assembly as defined by claim 27 further comprising:

a guide plate disposed within said support tube, said lock guide tube being sandwiched between said guide plate and said elongated lock member.

29. An arm assembly as defined by claim 28 wherein said lock element is a ball bearing.

* * * * *